US010443280B2

(12) United States Patent
Hwang et al.

(10) Patent No.: US 10,443,280 B2
(45) Date of Patent: Oct. 15, 2019

(54) PRESSURE-TIGHT DOOR ALLOWING MOVEMENT OF HINGES

(71) Applicant: Jae Ho Hwang, Ulsan (KR)

(72) Inventors: Jae Ho Hwang, Ulsan (KR); Sung Jin Chang, Gyeongsangnam-do (KR)

(73) Assignee: Jae Ho Hwang, Ulsan (KR)

( * ) Notice: Subject to any disclaimer, the term of this patent is extended or adjusted under 35 U.S.C. 154(b) by 0 days.

(21) Appl. No.: 15/776,666

(22) PCT Filed: Nov. 18, 2016

(86) PCT No.: PCT/KR2016/013344
§ 371 (c)(1),
(2) Date: May 16, 2018

(87) PCT Pub. No.: WO2017/086737
PCT Pub. Date: May 26, 2017

(65) Prior Publication Data

US 2018/0328090 A1 Nov. 15, 2018

(30) Foreign Application Priority Data

Nov. 18, 2015 (KR) ..... 10-2015-0162004

(51) Int. Cl.
*E05D 15/06* (2006.01)
*E05D 7/04* (2006.01)
(Continued)

(52) U.S. Cl.
CPC ..... *E05D 7/04* (2013.01); *E02B 7/40* (2013.01); *E02B 7/54* (2013.01); *E05D 3/022* (2013.01);
(Continued)

(58) Field of Classification Search
CPC .. E05D 7/04; E05D 3/022; E05D 5/02; E05D 5/0215; E05D 11/00; E05B 7/20;
(Continued)

(56) References Cited

U.S. PATENT DOCUMENTS 2,777,156 A * 1/1957 Weisgarber ..... E05D 3/022 16/361
3,256,552 A * 6/1966 Sterner ..... E05D 3/022 16/273
(Continued)

FOREIGN PATENT DOCUMENTS

JP 07-017756 A 1/1995
JP 2002-318064 A 10/2002
(Continued)

OTHER PUBLICATIONS

Japanese Patent Abstract (in English) of Japanese Patent Pub. No. 07-017756 A, Pub. Date Jan. 20, 1995, downloaded May 14, 2018 from https://www4.j-platpat.inpit.go.jp/eng/.
(Continued)

*Primary Examiner* — Chuck Y Mah
(74) *Attorney, Agent, or Firm* — Barcelo, Harrison & Walker, LLP

(57) ABSTRACT

A pressure-tight door allowing movement of hinges includes: a hinge fixating part including a fixed member having one surface with a movable groove formed therein and the other surface fixed to a door frame, and a movable member having one surface inserted into the movable groove so as to slide bidirectionally on the movable groove and a hinge attached to the other surface of the movable member, connected to a door and sliding together with the movable member. The movable member of the hinge fixating part slides inwardly together with the hinge only when the pressure due to flooding or explosion is applied to the
(Continued)

pressure-tight door, whereby the pressure-tight door is able to effectively block any leakage by compressing the gasket.

10 Claims, 13 Drawing Sheets

(51) Int. Cl.

| | |
|---|---|
| ***E06B 5/12*** | (2006.01) |
| ***E06B 7/16*** | (2006.01) |
| ***E05D 11/00*** | (2006.01) |
| ***E05D 5/02*** | (2006.01) |
| ***E06B 7/23*** | (2006.01) |
| ***E06B 9/04*** | (2006.01) |
| ***E05D 3/02*** | (2006.01) |
| ***E02B 7/40*** | (2006.01) |
| ***E02B 7/54*** | (2006.01) |
| *E06B 9/00* | (2006.01) |

(52) U.S. Cl.
CPC ..... *E05D 5/02* (2013.01); *E05D 5/0215* (2013.01); *E05D 11/00* (2013.01); *E06B 5/12* (2013.01); *E06B 7/16* (2013.01); *E06B 7/2309* (2013.01); *E06B 9/04* (2013.01); *E05Y 2600/10* (2013.01); *E05Y 2800/428* (2013.01); *E05Y 2900/132* (2013.01); *E06B 2009/007* (2013.01)

(58) Field of Classification Search
CPC ..... E02B 8/00; E06B 5/00; E06B 5/12; E06B 7/16; E06B 7/2309; E06B 9/04; E06B 2009/007; E05Y 2600/10; E05Y 2800/428; E05Y 2900/132; Y10T 16/545; Y10T 16/5457; Y10T 16/5323; Y10T 16/53257
See application file for complete search history.

(56) References Cited

U.S. PATENT DOCUMENTS

| | | | | |
|---|---|---|---|---|
| 4,424,606 | A * | 1/1984 | Sorimachi | E05F 1/1261 16/223 |
| 4,539,727 | A * | 9/1985 | Mautner | E05F 1/1215 16/277 |
| 6,151,755 | A * | 11/2000 | Rozema | B63B 19/08 16/357 |
| 7,934,782 | B2 * | 5/2011 | Christie | E05D 3/022 16/361 |
| 9,420,903 | B2 * | 8/2016 | Litalien | A47G 1/06 |
| 9,752,374 | B2 * | 9/2017 | Fu | E06B 3/509 |
| 2014/0150345 | A1 * | 6/2014 | Price | E05D 3/022 49/381 |

FOREIGN PATENT DOCUMENTS

| | | | |
|---|---|---|---|
| KR | 10-1199472 | B1 | 11/2012 |
| KR | 10-2013-0059835 | A1 | 6/2013 |
| KR | 10-1284732 | B1 | 7/2013 |
| KR | 10-1373238 | B1 | 3/2014 |

OTHER PUBLICATIONS

Japanese Patent Abstract (in English) of Japanese Patent App. Pub. No. 2002-318064 A, Pub. Date Oct. 31, 2002, downloaded May 14, 2018 from https://www4.j-platpat.inpit.go.jp/eng/.

Korean Patent Abstract (in English) of KR Patent App. Pub. No. 101265680 A1, Pub. Date Jun. 7, 2013, downloaded May 14, 2018 from http://engpat.kipris.or.kr/engpat/biblioa.do.

Korean Patent Abstract (in English) of KR Patent Pub. No. 10-1199472 B1, Pub. Date Nov. 9, 2012, downloaded May 14, 2018 from http://engpat.kipris.or.kr/engpat/biblioa.do.

Korean Patent Abstract (in English) of KR Patent Pub. No. 10-1284732 B1, Pub. Date Jul. 17, 2013, downloaded May 14, 2018 from http://engpat.kipris.or.kr/engpat/biblioa.do.

Korean Patent Abstract (in English) of KR Patent Pub. No. 10-1373238 B1, Pub. Date Mar. 12, 2014, downloaded May 14, 2018 from http://engpat.kipris.or.kr/engpat/biblioa.do.

International Search Report from Korean Intellectual Property Office for International Application No. PCT/KR2016/013344 dated Mar. 9, 2017.

* cited by examiner

PRESSURE-TIGHT DOOR ALLOWING MOVEMENT OF HINGES

CROSS-REFERENCE TO RELATED APPLICATIONS

This application is the national stage for International Patent Cooperation Treaty Application PCT/KR2016/013344, filed Nov. 18, 2016, which claims priority from Korean Patent Application No. 10-2015-0162004, filed Nov. 18, 2015, in the Korean Intellectual Property Office. The entire contents of said applications are incorporated herein by reference for all purposes.

BACKGROUND OF THE INVENTION

Technical Field

The present invention relates to a pressure-tight door allowing the movement of hinges, in which a hinge fixating part including a fixed member and a movable member is installed between a door frame and a hinge to which the pressure-tight door is connected, such that the pressure-tight door slides together with the hinge by the movable member.

Background Art

Recently, flooding accidents in which water is introduced into the interior have occurred due to floods or tsunamis in industrial facilities such as power plants and industrial complexes which are located on the coasts, thus causing many human casualties and economic losses. In addition, in case of gas leakage and explosion accidents in industrial facilities, gas should not leak out. In this regard, pressure-tight doors serving as special doors for preventing damage from flooding and gas leakage are installed in many places such as power plants, industrial complex, and major national facilities. However, as illustrated in FIG. 2, when water pressure or gas explosion pressure is applied to the pressure-tight door, a certain amount of compression is required in order for a gasket to exhibit pressure-tight performance. Therefore, the pressure-tight door has to be closed with a certain amount of force so as to make the gasket compressed.

Before any disaster, however, the automatic closing capability of the pressure-tight door functions only when the gasket remains uncompressed. Therefore, the gasket should not be compressed at normal times, but when any disaster occurs, the gasket should be compressed by water pressure or gas explosion pressure, so that the pressure-tight performance is exhibited.

In addition, when some other movable hinges are used instead to allow the gasket compressed, it is difficult to align the axes of the hinges along a vertical line, causing a problem in operation of the pressure-tight door.

Technical Problems

The present invention has been made in an effort to solve the above-described problems, and it is an objective of the present invention to provide a pressure-tight door with movement of hinges. A hinge fixating part including a fixed member and a movable member is installed between a door frame and a hinge such that the pressure-tight door slides to compress a gasket together with the hinge due to the pressure applied to the pressure-tight door. The hinge attached to the movable member slides bidirectionally on the fixed member together with the movable member.

Technical Solutions

In order to achieve the above objective, a pressure-tight door should allow movement of hinges by utilizing a hinge fixating part. This includes a fixed member having one surface with a movable groove formed therein and the other surface fixed to the door frame, and a movable member having one surface inserted into the movable groove so as to slide bidirectionally on the movable groove and the other surface with an attached hinge connected to the pressure-tight door, which will slide together with the movable member.

Insertion grooves may be formed at lower ends of both sidewalls in the movable groove of the fixed member, and sliding devices protruding on both sides of the movable member may be inserted into the insertion grooves, such that the movable member slides due to sliding movement of the sliding devices in the insertion grooves.

The sliding devices may be installed on both sides of the movable member, or both sides or a lower portion of the movable member.

The insertion grooves may be formed from the inside of the movable groove of the fixed member to the end of the outer side thereof and form a step, such that the step serves as a stopper for preventing the sliding device from being released from the movable groove of the fixed member.

The sliding device may be a caster or an oil bush.

The pressure-tight door may further include an elastic member disposed between an inner wall surface of the movable groove of the fixed member and the movable member. The elastic member may be a spring made of a metallic material or a rubber material. The elastic member may be a cylindrical spring, a corrugated spring, or an arc-shaped spring.

Advantageous Effects

According to the present invention of a pressure-tight door allowing movement of hinges, the movable member of a hinge fixating part slides inwardly together with the attached hinge only when the pressure due to flooding or explosion is applied to the pressure-tight door, whereby the pressure-tight door is able to effectively block any leakage by compressing the gasket.

In addition, when the applied pressure is released, the movable member of the hinge fixating part slides outwardly together with the hinge due to elasticity of an elastic member, whereby the pressure-tight door returns quickly to the original position thereof.

DETAILED DESCRIPTION

Best Mode

Hereinafter, preferred embodiments of a pressure-tight door allowing movement of hinges according to the present disclosure will be described in detail with reference to the accompanying drawings. However, it should be understood that the present invention is not limited to the following embodiments, and various modifications can be made without departing from the scope of the present invention. The embodiments set forth herein are provided such that this disclosure will be thorough and complete, and will fully convey the concept of the invention to those skilled in the art.

Figure 1:
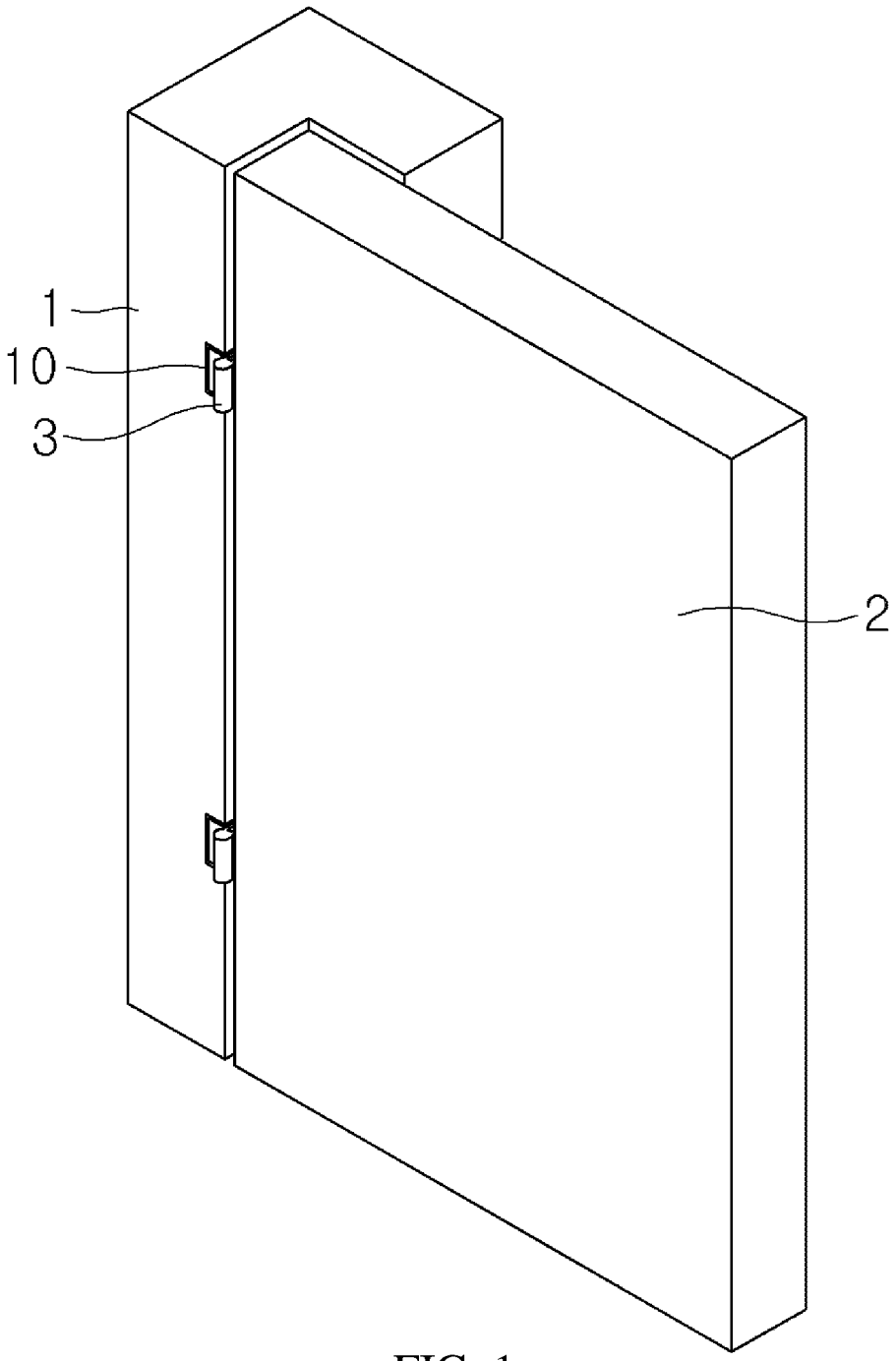
FIG. 1 is a perspective view illustrating an installation position of a hinge fixating part of a pressure-tight door allowing movement of hinges, according to an embodiment of the present invention.
Figure 2A:
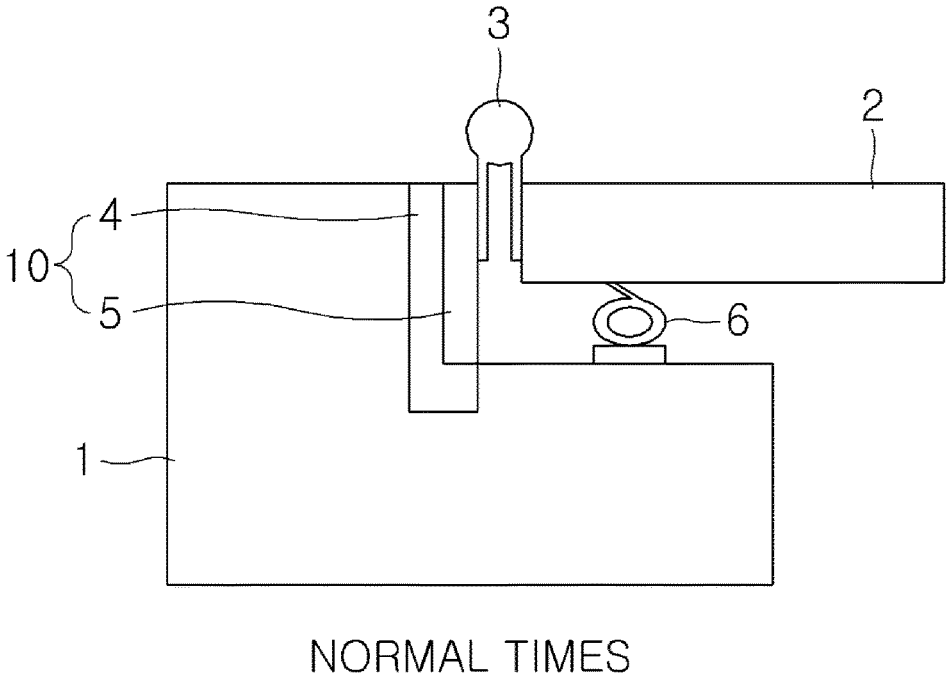
FIGS. 2A and 2B are longitudinal sectional views illustrating the operation of the hinge fixating part of the pressure-tight door allowing movement of hinges, according to an embodiment of the present invention.
Figure 2B:
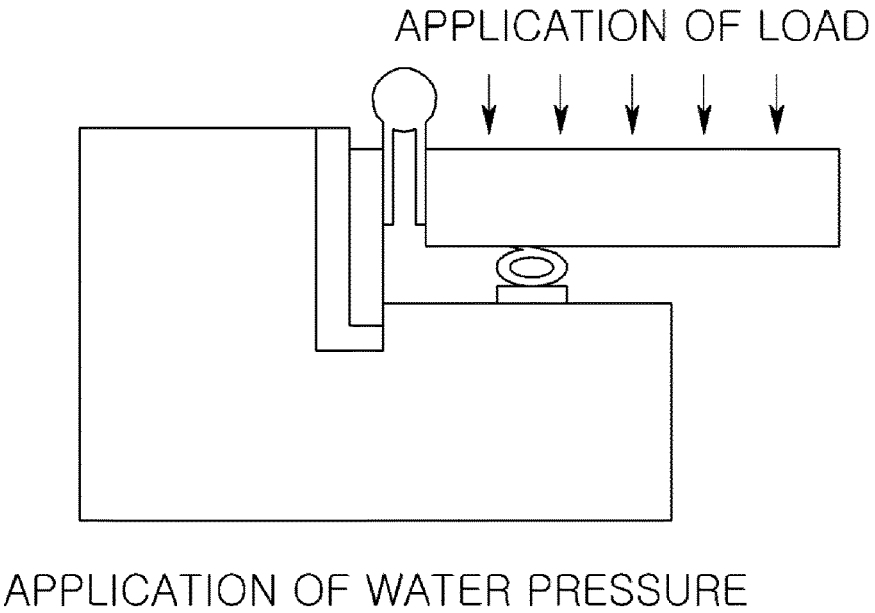

FIG. 1 is a perspective view illustrating an installation position of a hinge fixating part of a pressure-tight door allowing movement of hinges, according to an embodiment of the present invention, and FIGS. 2A and 2B are longitudinal sectional views illustrating the operation of the hinge fixating part of the pressure-tight door allowing movement of hinges, according to an embodiment of the present invention.

As illustrated in FIGS. 1, 2A, and 2B, the pressure-tight door allowing movement of hinges according to the present invention includes a hinge fixating part 10 installed between a door frame 1 and a hinge 3 to which the pressure-tight door 2 is connected. The hinge fixating part 10 includes a fixed member 4 fixed to the door frame 1, and a movable member 5 connected to the fixed member 4 and having one surface attached to the hinge 3.

The movable member 5 may reciprocate in the form of sliding movement on the fixed member 4 together with the hinge 3. The movable member 5 does not move at normal times (a). When a water pressure is applied to the pressure-tight door 2 and thus a load is applied thereto, the movable member 5 slides inwardly on the fixed member 4 together with the hinge 3(*b*).

The pressure-tight door 2 also slides inwardly to compress the gasket 6.

Figure 3:
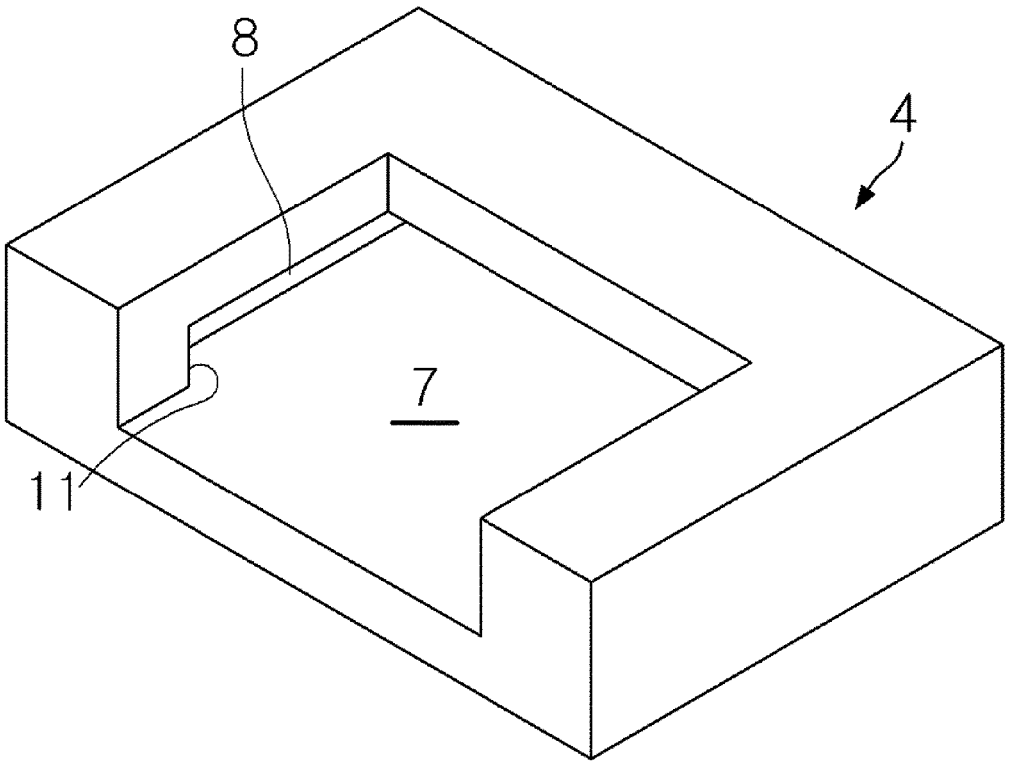
FIG. 3 is a perspective view illustrating a fixed member of the hinge fixating part of the pressure-tight door allowing movement of hinges, according to an embodiment of the present invention.
Figure 4A:
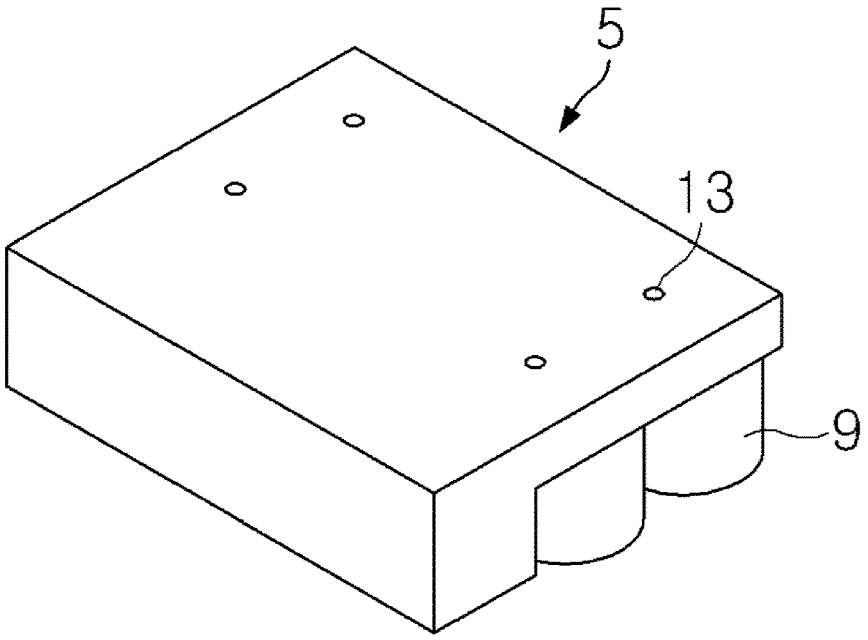
FIGS. 4A and 4B are front and rear perspective views illustrating a movable member of the hinge fixating part of the pressure-tight door allowing movement of hinges, according to an embodiment of the present invention.
Figure 4B:
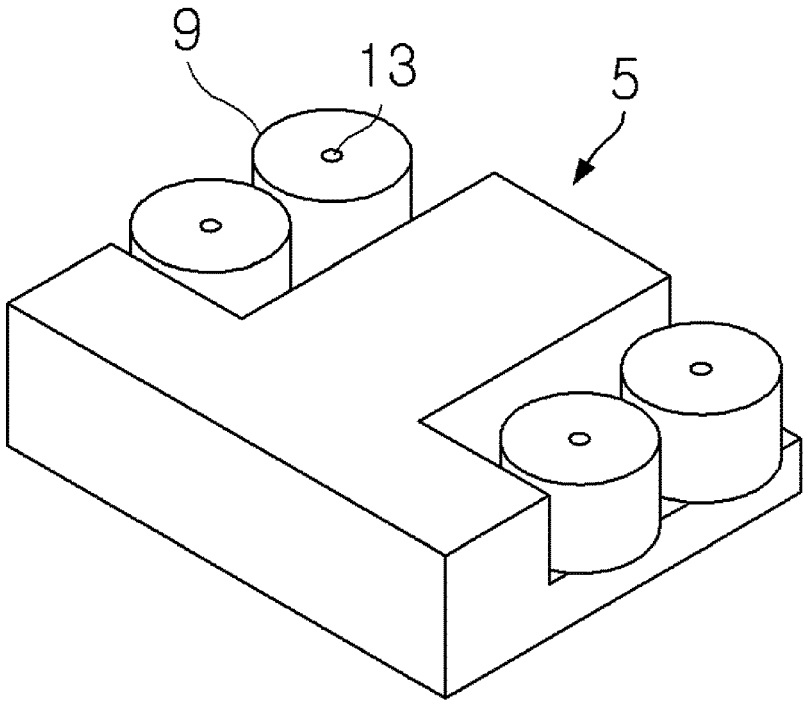

FIG. 3 is a perspective view illustrating the fixed member of the hinge fixating part of the pressure-tight door allowing movement of hinges, according to an embodiment of the present invention, and FIGS. 4A and 4B are front and rear perspective views, respectively, illustrating the movable member of the hinge fixating part of the pressure-tight door allowing movement of hinges, according to an embodiment of the present invention.

As illustrated in FIG. 3, in the fixed member 4 of the hinge fixating part of the pressure-tight door allowing movement of hinges according to the present invention, a movable groove 7 opened to the outside is formed on one surface thereof. In lower ends of both sidewalls of the movable groove 7, insertion grooves 8 are formed lengthily inside the sidewalls. Each of the insertion grooves 8 does not extend to the outer end, but is formed only from the outer end to the slight inner side such that a step 11 is formed. In addition, as illustrated in FIGS. 4A and 4B, in the movable member 5 of the hinge fixating part of the pressure-tight door allowing movement of hinges according to the embodiment of the present invention, a hinge is attached to one side thereof, and a pair of casters 9 serving as sliding devices are fixed to both sides of the other surface thereof by rotating pins 13, so as to rotate while protruding side by side.

Mode of the Invention

Figure 5:
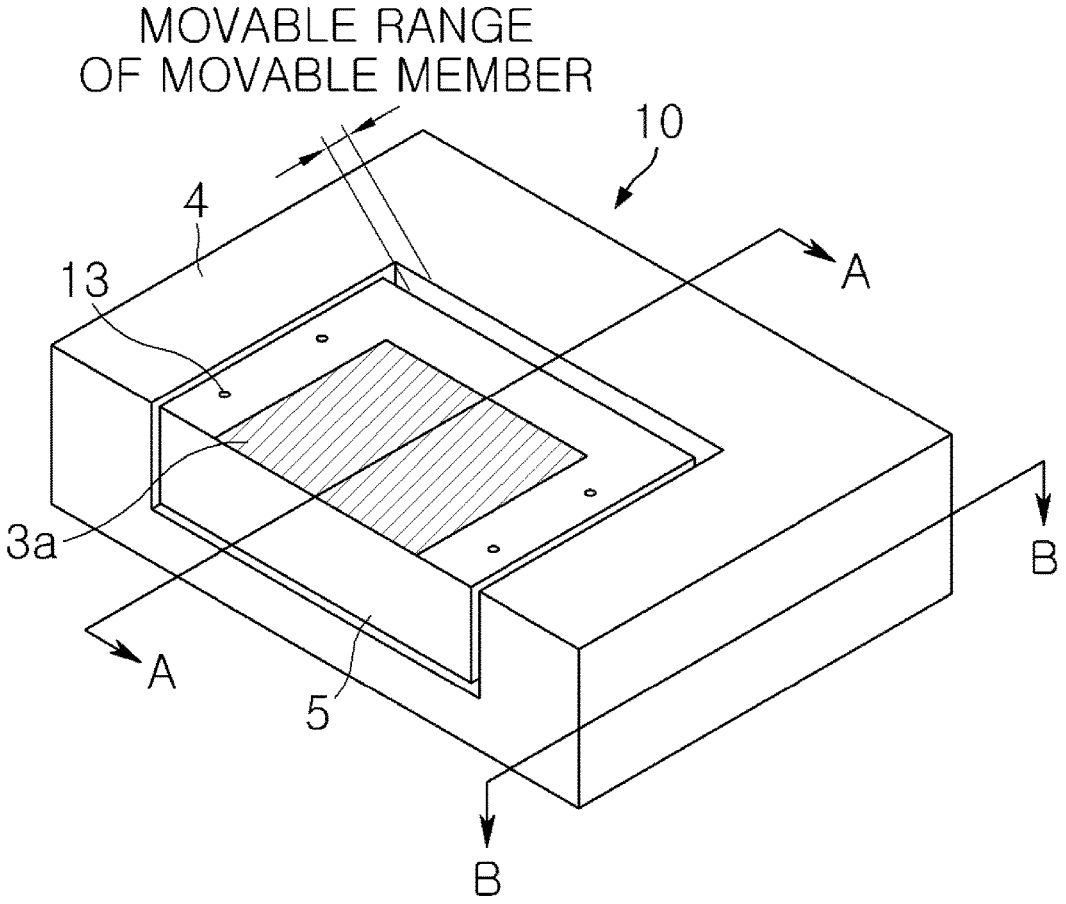
FIG. 5 is a perspective view illustrating the hinge fixating part of the pressure-tight door allowing movement of hinges, according to an embodiment of the present invention.
Figure 6:
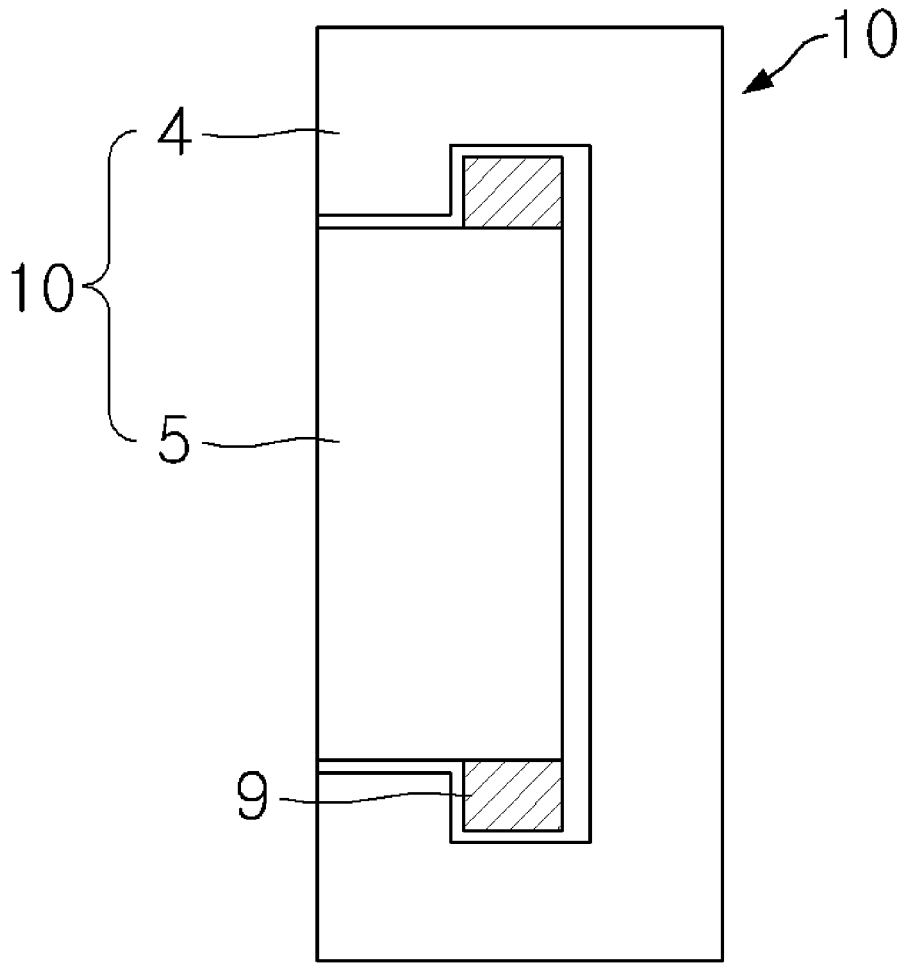
FIG. 6 is an A-A longitudinal sectional view of FIG. 5.

FIG. 5 is a perspective view illustrating the hinge fixating part of the pressure-tight door allowing movement of hinges, according to an embodiment of the present invention, FIG. 6 is an A-A longitudinal sectional view of FIG. 5, and FIGS. 7A, 7B and 7C are B-B cross-sectional views of FIG. 5 illustrating various shapes of an elastic member.

As illustrated in FIGS. 5 to 7A, 7B, and 7C, in the hinge fixating part 10 of the pressure-tight door allowing movement of hinges according to the present invention, the movable member 5 of FIGS. 4A and 4B is inserted into and connected to the movable groove 7 of the fixed member 4 of FIG. 3, and the casters 9 protruding on both sides of the movable member 5 are inserted into and connected to the insertion grooves 8 of the fixed member 4. Therefore, the casters 9 rolls and slides in the insertion grooves 8, such that the movable member 5 performs a sliding and reciprocating movement inwardly and outwardly in the movable groove 7 of the fixed member 4. A part of one surface of the movable member 5 is a hinge installation part 3*a* to which one wing of the hinge 3 is attached and fixed, and the other wing of the hinge 3 is fixedly installed within the pressure-tight door.

As illustrated in FIG. 7, when the casters 9 move while rolling in the insertion grooves 8, the insertion grooves 8 do not extend to the outer end of the movable groove 7 but do extend to the step 11. Thus, when the casters 9 roll and the movable member 5 slides outwardly, the step 11 serves as a stopper for limiting the movement of the casters 9. Therefore, the movable member 5 is not released out of the movable groove 7 of the fixed member 4.

After the movable member 5 moves inwardly from the movable groove 7 of the fixed member 4, the movable member 5 needs to return to the original position, that is, the outer side. In this case, as illustrated in FIG. 7, an elastic member 12 such as a spring is inserted and fixed between the inner wall surfaces of the movable groove 7 of the fixed member 4 and the movable member 5. Therefore, when the movable member 5 slides inwardly together with the hinge 3 by the water pressure applied to the pressure-tight door 2 and thus the pressure-tight door 2 presses the gasket 6, the elastic member 12 between the inner wall surfaces of the movable groove 7 of the fixed member 4 and the movable member 5 is also compressed. Thereafter, when the water pressure applied to the pressure-tight door 2 is released, the compressed elastic member 12 is restored, and the movable member 5 naturally slides outwardly together with the hinge 3, such that the pressure-tight door 2 returns back to the original position.

As illustrated in FIG. 5, when the movable member 5 slides, the interval between the inner wall surfaces of the movable groove 7 of the fixed member 4 and the movable member 5, with the elastic member 12 being inserted therebetween, becomes a range in which the movable member 5 is moving.

Figure 7A:
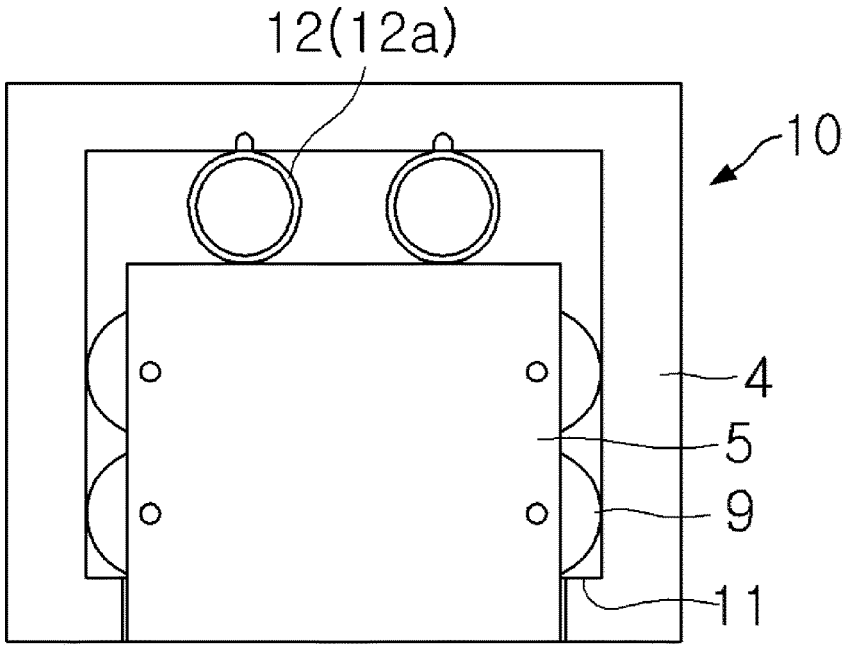
FIGS. 7A, 7B and 7C are B-B cross-sectional views of FIG. 5, illustrating various shapes of an elastic member.
Figure 7B:
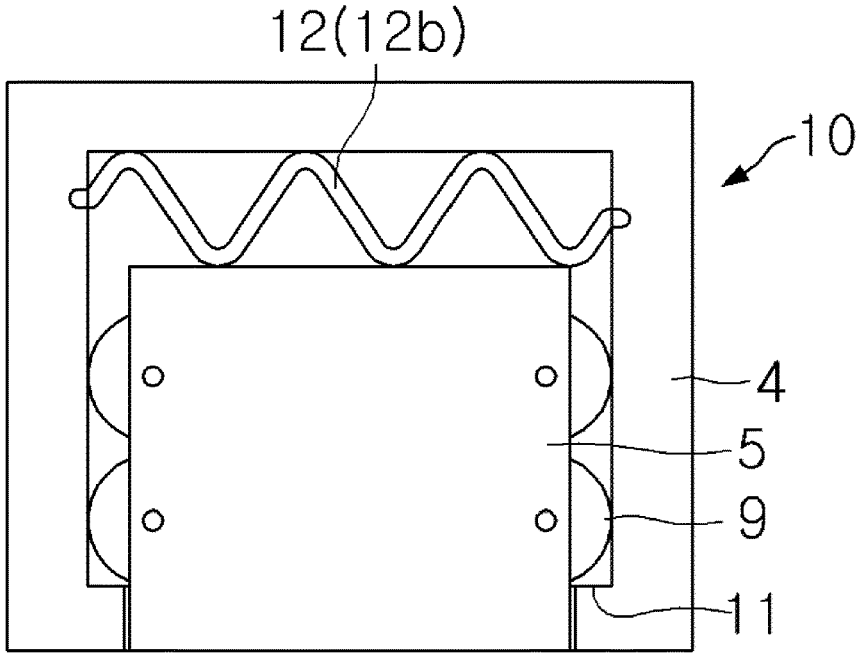
Figure 7C:
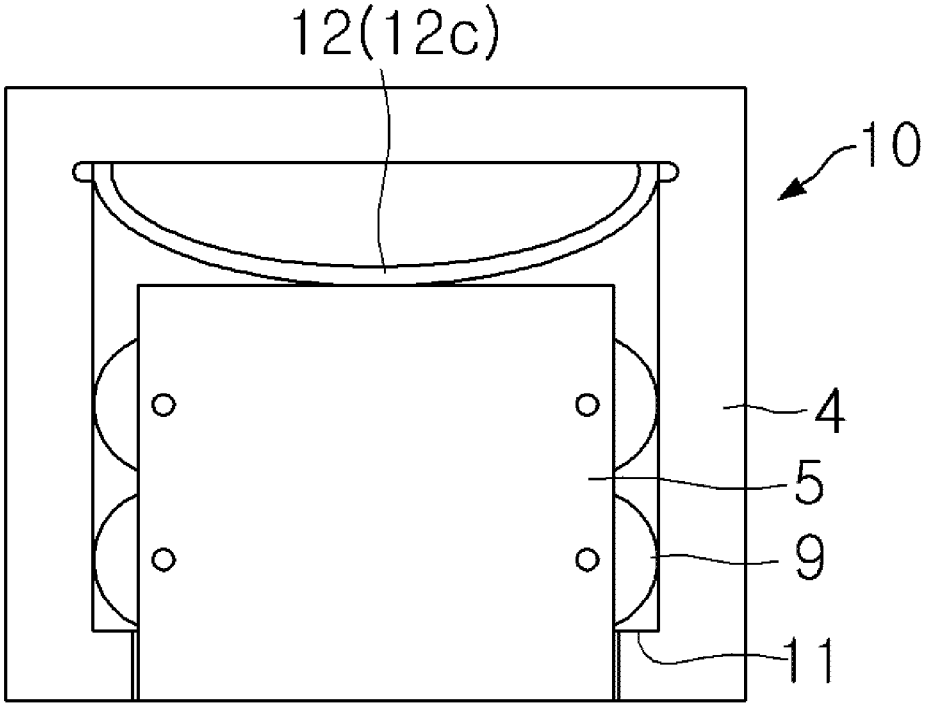
Figure 8A:
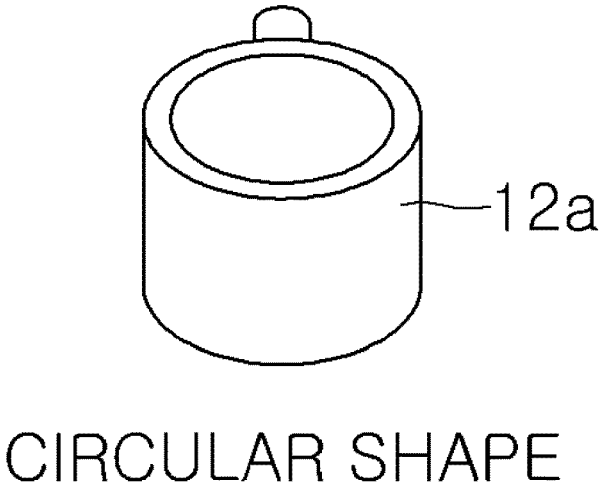
FIGS. 8A, 8B and 8C are perspective views illustrating various embodiments of a spring as the elastic member.
Figure 8B:
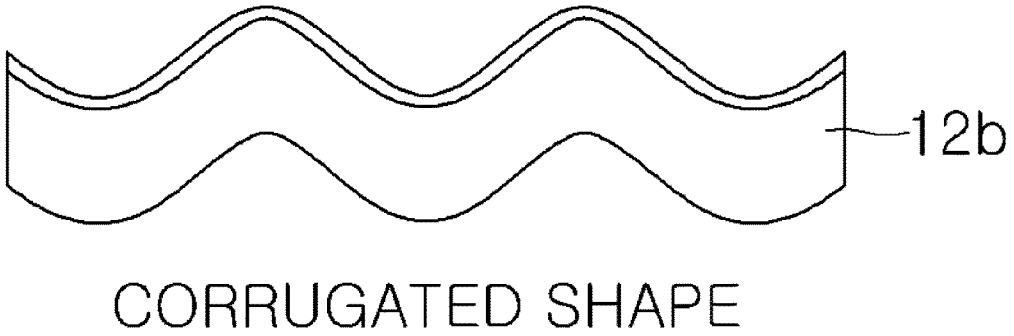
Figure 8C:
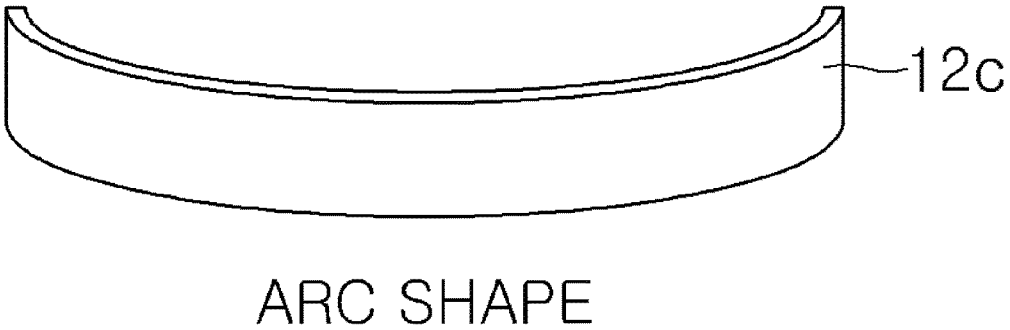

The spring made of a metallic material or a rubber material, which is a specific form of the elastic member 12, may be formed in various shapes. As illustrated in FIGS. 7A and 8A, the spring may be configured by a circular spring 12*a*, of which one side of the circular periphery is fixed to the inner wall surface of the movable groove 7. As illustrated in FIGS. 7B and 8B, the spring may be configured by a corrugated spring 12*b*, of which both ends of the corrugated shape are fixed to both sidewalls of the movable groove 7. As illustrated in FIGS. 7C and 8C, the spring may be configured by an arc-shaped spring 12*c*, of which both ends of the arc shape are fixed to both inner edges of the movable groove 7. The elastic member 12 may be formed of various materials and shapes, in addition to the spring made of the metallic material or the rubber material.

Figure 9:
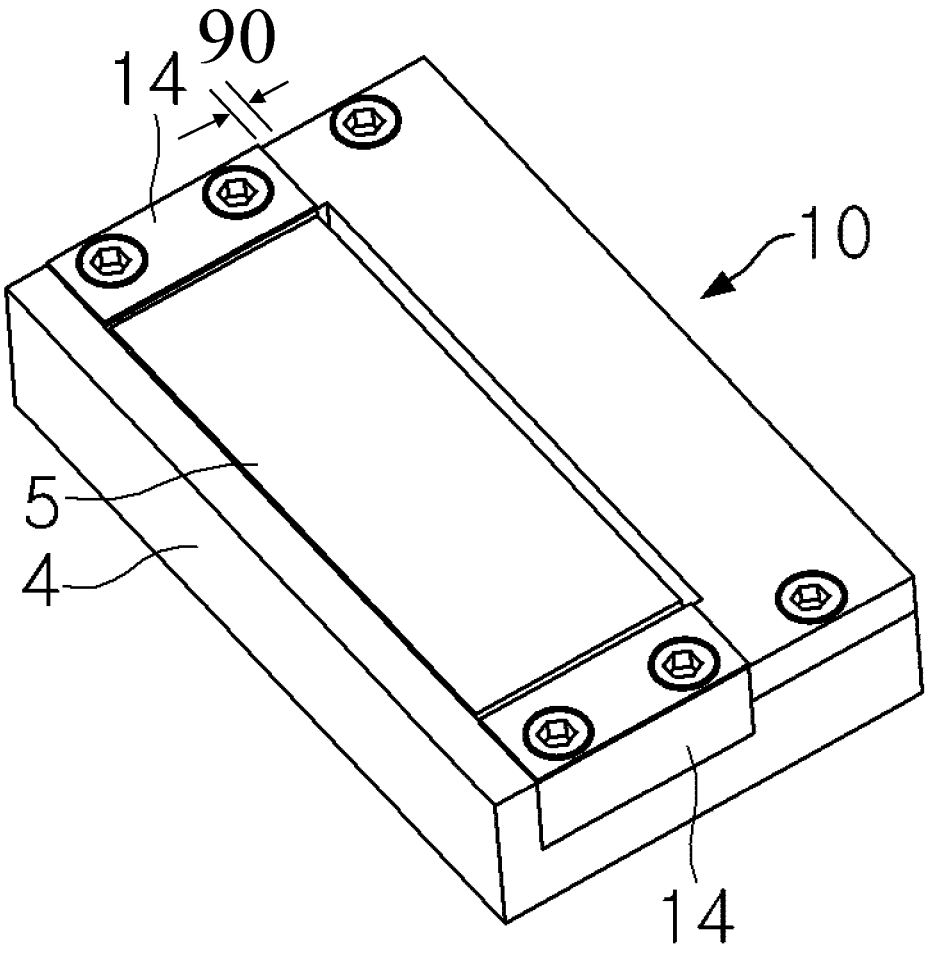
FIG. 9 is a perspective view illustrating a hinge fixating part of a pressure-tight door allowing movement of hinges, according to another embodiment of the present invention.
Figure 10:
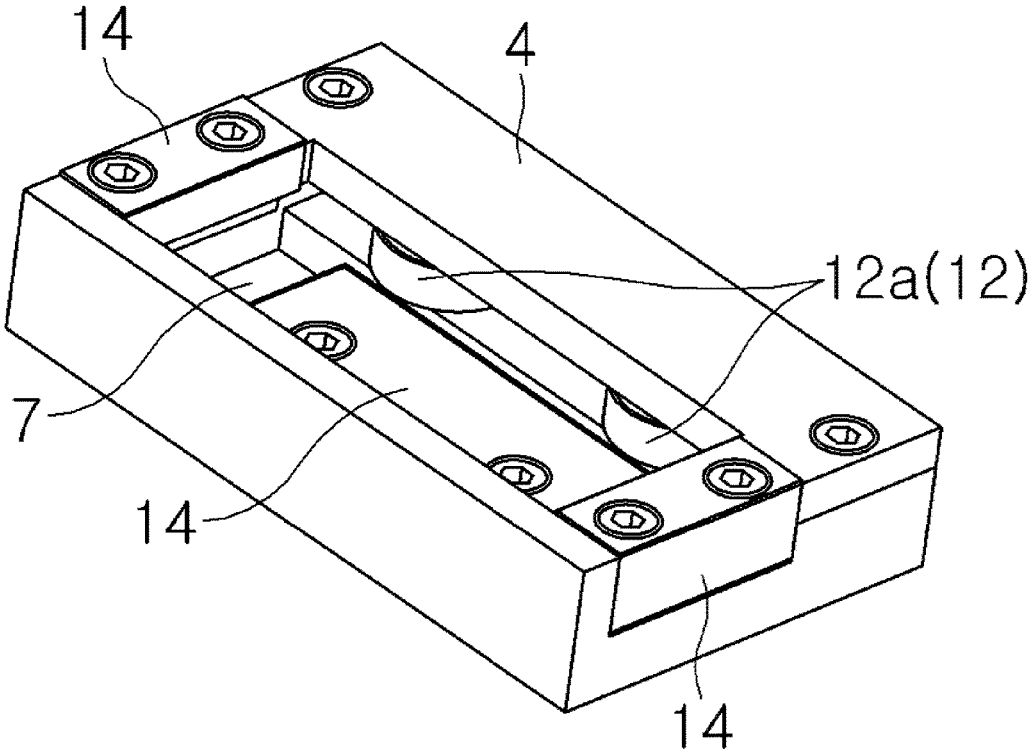
FIG. 10 is an internal perspective view illustrating the hinge fixating part of the pressure-tight door allowing movement of hinges, according to another embodiment of the present invention.
Figure 11:
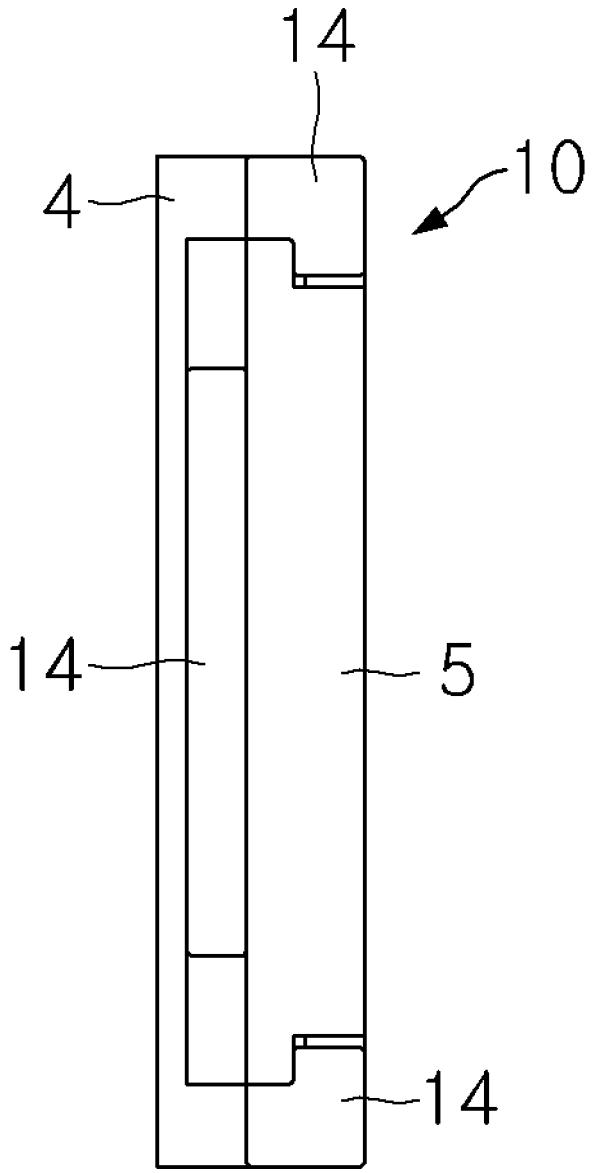
FIG. 11 is a cross-sectional view illustrating the installation state of the hinge fixating part of the pressure-tight door allowing movement of hinges, according to another embodiment of the present invention.

FIG. 9 is a perspective view illustrating a hinge fixating part of a pressure-tight door allowing movement of hinges, according to another embodiment of the present invention, FIG. 10 is an internal perspective view illustrating the hinge fixating part of the pressure-tight door allowing movement of hinges, according to another embodiment of the present invention, and FIG. 11 is a cross-sectional view illustrating the installed state of the hinge fixating part of the pressure-tight door allowing movement of hinges, according to another embodiment of the present invention.

As illustrated in FIGS. 9 to 11, in the hinge fixating part of the pressure-tight door allowing movement of hinges according to another embodiment of the present invention, an oil bush 14 is installed as another example of a sliding device. The oil bush 14 is installed on both sides and a lower portion of a movable member 5, and oil is applied on one side of the bush contacting the movable member 5. As such, due to the oil, the movable member 5 slides along the oil bush 14 on the both sides of the movable member 5, that is, both sides of a movable groove 7 of a fixed member 4 fixed to a hinge 3 and a lower surface of the movable member 5. The movable range of movable member 5 is labeled in FIG. 9 as length 90. When the movable member 5 slides by the oil bush 14, the pressure-tight door 2 moves and presses the gasket 6 as described above.

Although the casters 9 and the oil bush 14 have been described above as an example of the sliding device, various types of sliding devices other than the casters 9 and the oil bush 14 may be applied and used. In addition, even in the pressure-tight door to which the oil bush 14 is applied, according to the present invention, the elastic member 12 is installed in the same manner.

While the pressure-tight door allowing movement of hinges according to the present invention has been particularly shown and described with reference to exemplary embodiments thereof, it will be understood by those with ordinary skill in the art that various changes in form and details may be made therein without departing from the spirit and scope of the present invention as defined by the following claims.

INDUSTRIAL APPLICABILITY

The present invention can be effectively used as a pressure-tight door allowing movement of hinges, in which a movable member of a hinge fixating part slides inwardly together with the attached hinge only when the pressure due to flooding or explosion is applied to the pressure-tight door, whereby the pressure-tight door is able to effectively block any leakage by compressing the gasket.

In addition, the present invention is effectively used as a pressure-tight door allowing movement of hinges, in which when the applied pressure is released, a movable member of a hinge fixating part slides outwardly due to elasticity of an elastic member together with the hinge, whereby the pressure-tight door returns quickly to the original position thereof.

What is claimed is:

1. A pressure-tight door allowing movement of hinges, comprising:

a hinge fixating part including a fixed member having one surface with a movable groove formed therein and the other surface fixed to a door frame, and a movable member having one surface inserted into the movable groove so as to slide bidirectionally on the movable groove; and a hinge attached to the other surface of the movable member, connected to a door and sliding together with the movable member.

2. The pressure-tight door of claim 1, wherein insertion grooves are formed at lower ends of both sidewalls in the movable groove of the fixed member, and sliding devices protruding on both sides of the movable member are inserted into the insertion grooves, such that the movable member slides due to sliding movement of the sliding devices in the insertion grooves.

3. The pressure-tight door of claim 2, wherein the sliding devices are installed on both sides of the movable member, or both sides or a lower portion of the movable member.

4. The pressure-tight door of claim 2, wherein the insertion grooves are formed from the inside of the movable groove of the fixed member to the end of the outer side thereof and form a step, such that the step serves as a stopper for preventing the sliding device from being released from the movable groove of the fixed member.

5. The pressure-tight door of claim 3, wherein the sliding device is a caster or an oil bush.

6. The pressure-tight door of claim 2, further comprising an elastic member disposed between an inner wall surfaces of the movable groove of the fixed member and the movable member.

7. The pressure-tight door of claim 6, wherein the elastic member is a spring made of a metallic material or a rubber material.

8. The pressure-tight door of claim 7, wherein the elastic member is a cylindrical spring.

9. The pressure-tight door of claim 7, wherein the elastic member is a corrugated spring.

10. The pressure-tight door of claim 7, wherein the elastic member is an arc-shaped spring.

* * * * *